US005613483A

United States Patent [19]

Lukas et al.

[11] Patent Number: 5,613,483

[45] Date of Patent: Mar. 25, 1997

[54] GAS POWERED GUN

[76] Inventors: Michael A. Lukas, 25 Pol Ct., St. Thomas, Ontario, Canada, N5R 5P9; Roger L. Hurst, 1253 Thistledown Ave.; Lee D. Kirwan, 1223 Thistledown Ave., both of Sarnia, Ontario, Canada, N7S 5A8

[21] Appl. No.: 555,625

[22] Filed: Nov. 9, 1995

[51] Int. Cl.[6] ..... F41B 11/00

[52] U.S. Cl. ..... 124/73; 124/74; 124/75; 124/70

[58] Field of Search ..... 124/73, 74, 75, 124/70

[56] References Cited

U.S. PATENT DOCUMENTS

| | | | |
|---|---|---|---|
| 2,881,752 | 4/1959 | Blahnik | 124/75 |
| 3,204,625 | 9/1965 | Shepherd | 124/74 |
| 4,850,330 | 7/1989 | Nagayohsi | 124/73 X |
| 4,936,282 | 6/1990 | Dobbins et al. | 124/73 X |
| 5,078,118 | 1/1992 | Perrone | 124/74 |
| 5,257,614 | 11/1993 | Sullivan | 124/74 X |
| 5,265,582 | 11/1993 | Bhogal | 124/73 |
| 5,280,778 | 1/1994 | Kotsiopoulos | 124/73 |
| 5,349,938 | 9/1994 | Farrell | 124/73 |
| 5,383,442 | 1/1995 | Tippmann | 124/73 X |
| 5,505,188 | 4/1996 | Williams | 124/74 |
| 5,509,399 | 4/1996 | Poor | 124/74 X |

*Primary Examiner*—Randolph A. Reese
*Assistant Examiner*—Thomas A. Beach
*Attorney, Agent, or Firm*—Rogers & Scott

[57] ABSTRACT

A piston and cylinder assembly for a gas powered gun, has a cylinder containing a piston rod slidably movable between a loading position in which the leading end of the piston rod is in a withdrawn position, and a firing position in which the piston rod has moved forwardly. The cylinder has first and second chambers through which the piston rod extends, the cylinder being connectable to a pressurized gas supply supplying pressurized gas to the first chamber when the piston rod is in the loading position. The piston rod permits communication between the pressurized gas supply and the first chamber and prevents communication between the first and second chambers when in the loading position, and when in the firing position prevents communication between the pressurized gas supply and the first chamber and permits communication between the first chamber and the second chamber to cause pressurized gas in the first chamber to pass into the second chamber. The piston rod has a longitudinally extending passage extending from the front and rearwardly along the piston rod to a location where the passage communicates with the exterior of the piston rod. The location communicates with the second chamber when the piston rod is in the firing position to cause pressurized gas to pass from the second chamber into the longitudinally extending passage to the front end of the piston rod for propelling a projectile from the barrel of a gas powered gun.

13 Claims, 4 Drawing Sheets

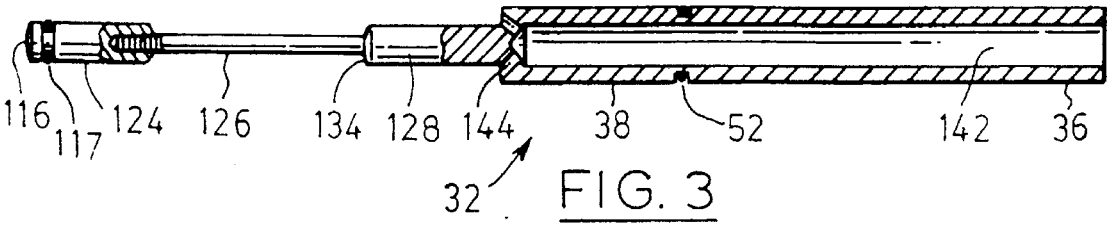
FIG. 3
FIG.4
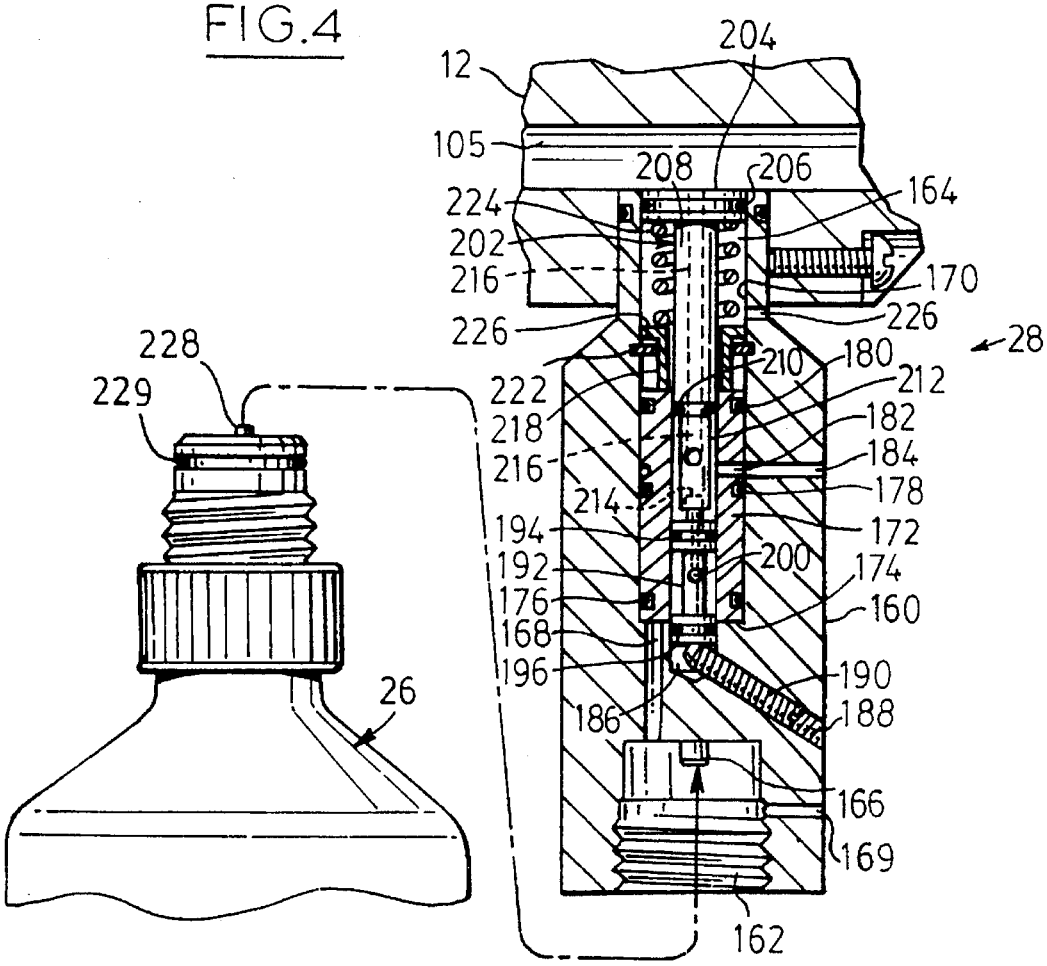

GAS POWERED GUN

BACKGROUND OF THE INVENTION

Such guns are used for example in the sport known as "Paintball" in which spherical projectiles containing coloured liquid are fired at an opponent and burst upon hitting the opponent so that the coloured liquid is deposited on the opponent. The spherical projectile is propelled from the gun by a pressurized gas, usually carbon dioxide, which is supplied from a small cylinder attached to the gun.

Although "Paintball" has been popular in the United States and Canada for several years, there is still a need for a gun with improved firing capabilities, i.e. a firing gas controlled system which more accurately controls the burst of gas which fires a paintball from the barrel of the gun.

It is therefore an object of the invention to provide a gas powered gun with an improved firing gas control system.

SUMMARY OF THE INVENTION

According to the present invention, a gas powered gun comprises a gun barrel, a cylinder containing a piston rod slidably movable between a loading position in which the leading end of the piston rod is sufficiently withdrawn in the barrel to permit a projectile to be fed into the barrel through an opening in the side thereof, and a firing position in which the piston rod has moved forwardly to cause the leading end of the piston rod to engage the projectile and move the projectile forwardly in the barrel, a trigger operable to cause the piston rod to move from the loading position to the firing position, and a pressurized gas supply.

The cylinder has first and second chambers through which the piston rod extends, the pressurized gas supply supplying pressurized gas to the first chamber when the piston rod is in the loading position, the piston rod permitting communication between the pressurized gas supply and the first chamber and preventing communication between the first and second chambers when in the loading position, and when in the firing position preventing communication between the pressurized gas supply and the first chamber and permitting communication between the first chamber and the second chamber to cause pressurized gas in the first chamber to pass into the second chamber.

The piston rod has a longitudinally extending passage extending from the front and rearwardly along the piston rod to a location where the passage communicates with the exterior of the piston rod, the location communicating with the second chamber when the piston rod is in the firing position to cause pressurized gas to pass from the second chamber into the longitudinally extending passage to the front end of the piston rod to propel the projectile from the gun barrel.

The cylinder may have a first member separating the first chamber from the second chamber, said first member having a first aperture through which the piston rod passes, and the piston rod having a first portion which is located in and closes the aperture when the piston rod is in the loading position and a second portion of lesser cross-section than the first portion which extends through the aperture when the piston rod is in the firing position to permit pressurized gas to pass from the first chamber through the first aperture into the second chamber.

The cylinder may have a second member separating a gas supply chamber from the first chamber, said second member having a second aperture through which the piston rod passes, and the piston rod having a third portion of smaller cross-section than the second aperture which is located in the second aperture when the piston rod is in the loading position to permit pressurized gas to pass from the gas supply chamber to the first chamber and a fourth portion of larger diameter than the third portion and which is located in and closes the second aperture when the piston rod is in the firing position to prevent pressurized gas from passing from the gas supply chamber into the first chamber.

The fourth portion of the piston rod may be adjacent the rear end thereof, and the cylinder has a rear portion which supports and guides the rear end of the piston rod.

The piston rod may be moved in at least one direction between said loading and firing positions by the pressurized gas supply, said gun having a valve receiving pressurized gas from the pressurized gas supply, said cylinder having an actuating portion through which the piston rod passes, and said valve being operatively connected to the trigger whereby movement of the trigger causes the valve to supply pressurized gas to the actuating portion of the cylinder to move the piston rod from one position to another.

Firing movement of the trigger may cause the valve to supply pressurized gas to the actuating portion of the cylinder to cause the piston rod to move from the loading position to the firing position, and release of the trigger after firing movement causes the valve to supply pressurized gas to the actuating portion of the cylinder to cause the piston rod to return from the firing position to the loading position.

The gun may also include an adjustable pressure regulator connected between the pressurized gas supply and the first chamber, said regulator comprising a regulator body having a piston slidable in a bore therein, said piston having a piston rod extending rearwardly therefrom, a spring surrounding piston rod and urging the piston to a forward position, the piston and piston rod having a passage extending therethrough, the housing also containing a sleeve in which a rear end portion of the piston rod slides, an adjustable spool slidably mounted in the sleeve below the piston rod, the pressurized gas supply being supplied to a rear end of the sleeve and the piston being acted upon by the regulator output pressure in a direction opposing said spring, the sleeve and the regulator body having passages which communicate with each other only when the pressurized gas supply is disconnected to vent pressure in the piston and piston rod passages to atmosphere.

DESCRIPTION OF PREFERRED EMBODIMENT

Figure 1:
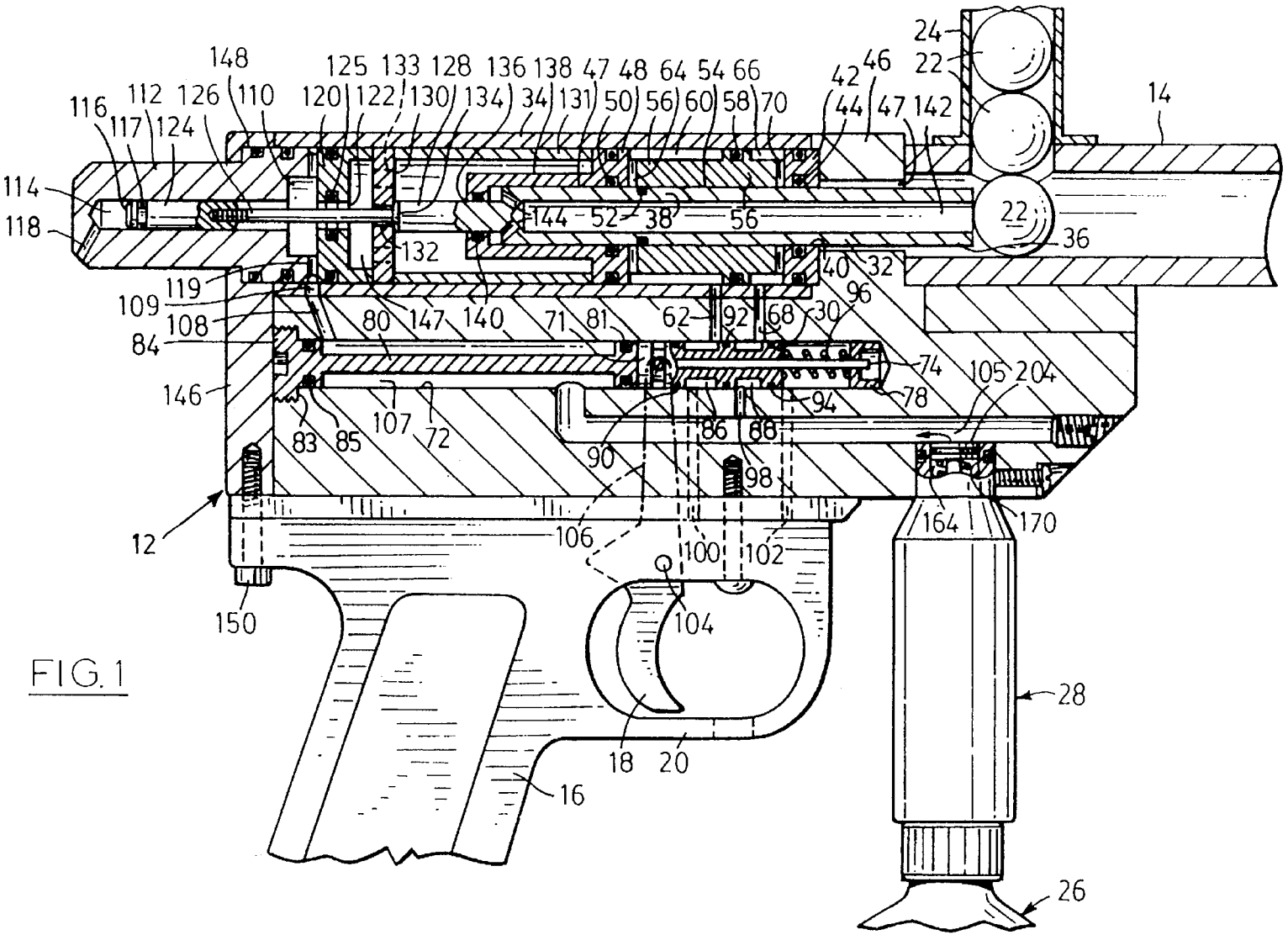
Figure 2:
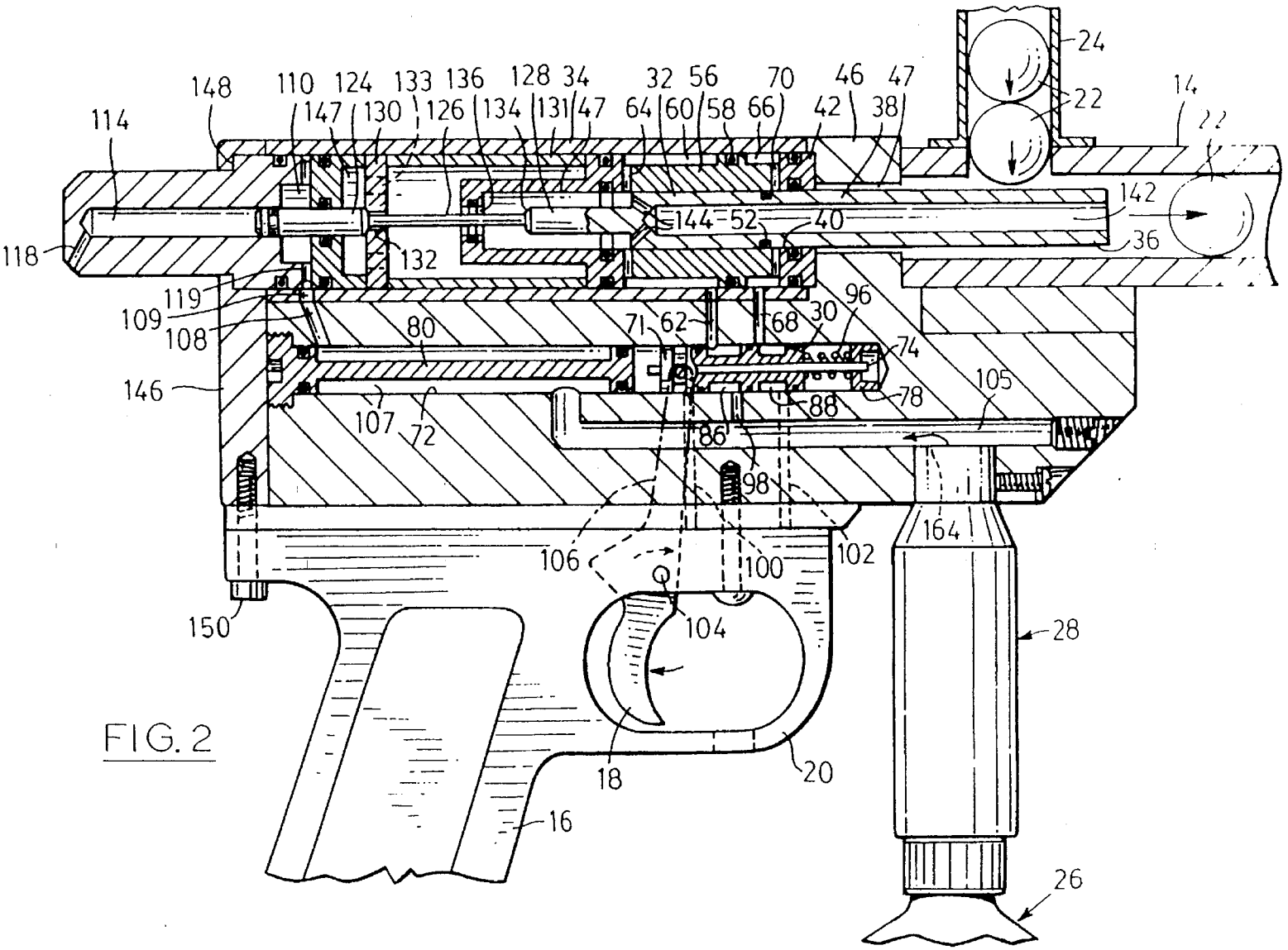
Figure 5:
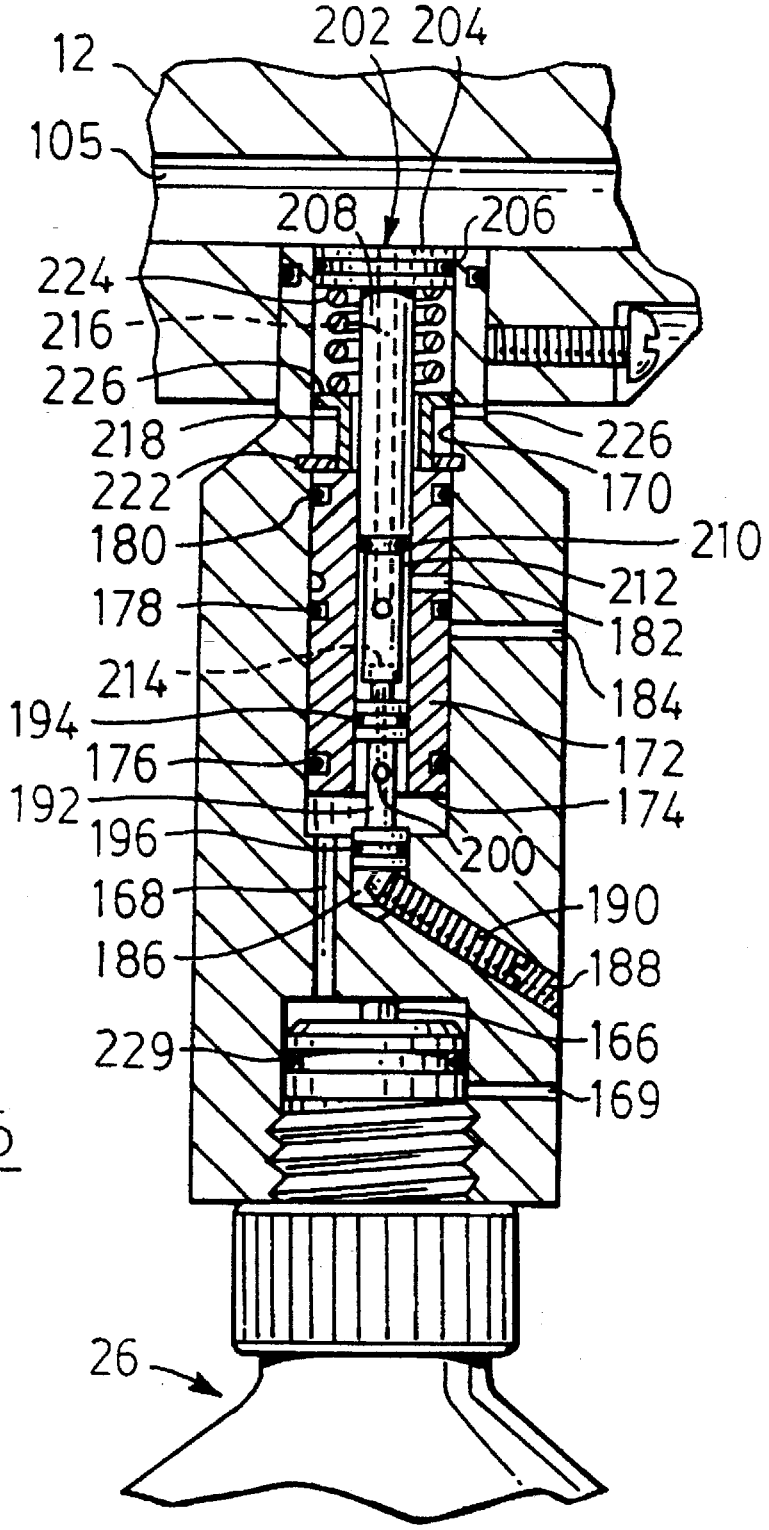

One embodiment of the invention will now be described, by way of example, with reference to the accompanying drawings, of which:

FIG. 1 is a diagrammatic sectional view of a paintball gun showing the piston rod in the loading position, FIG. 2 is a similar view showing the piston rod in the firing position, FIG. 3 is a side view, partly in section, of the piston rod, FIG. 4 is a sectional side view of the pressure regulator showing the various parts in their non-operating positions, and FIG. 5 is a similar view showing the various parts in their operating positions.

Referring to the drawings, a paintball gun has a housing 12 with a barrel 14 secured to and projecting from the forward end of the housing 12. A hand grip 16 is secured to the bottom of the housing 12, with a trigger 18 and trigger guard 20 being secured to the bottom of the housing 12 in front of the hand grip 16. Paintballs 22 are fed downwardly into the barrel 14 through a supply passage 24 in a manner known in the art. Pressurized gas is supplied from a carbon dioxide cylinder 26 which is attached to the lower end of a pressure regulator 28 whose upper end is attached to the bottom of the housing 12 forwardly of the trigger 18.

The housing 12 contains a spool valve 30 which is actuated by operation of the trigger 18, in a manner which will be described in more detail later, to cause a piston rod 32 to move from the loading position to the firing position.

The piston rod 32 is slidably mounted in a cylinder 34 carried by the housing 12, and has a front end portion 36 which projects forwardly from the cylinder 34 into the barrel 14. Rearwardly of the front end portion 36, the piston rod 32 has an intermediate portion 38, a forward part of which slides in an aperture 40 in an end member 42 secured to the front end of the cylinder 34. The aperture 40 contains a sealing ring 44 surrounding the intermediate portion 38 of the piston rod 34 in a sealing manner. It will be noted that the front surface of the end member 42 is seated in a rear surface of an upwardly projecting portion 46 of the housing 12, the upwardly projecting portion 46 having a passage 47 through which the front end portion 36 of the piston rod 32 passes. The rear part of the intermediate portion 38 of piston rod 32 slides in an aperture 46 in an intermediate member 48 mounted in the cylinder 34, the aperture 46 having a sealing ring 50 surrounding the intermediate piston portion 38 in a sealing manner.

The intermediate piston rod portion 38 carries a sealing ring 52 which slides in a passage 54 in an intermediate piston rod guide 56 mounted in the cylinder 34. The intermediate piston rod guide 56 has a sealing ring 58 extending around the circumference thereof and engaging the inner surface of cylinder 32. On the left hand side of sealing ring 58 (as seen in FIGS. 1 & 2), the intermediate piston rod guide 56 has a reduced diameter providing an annular passage 60 extending from a passage 62 in the housing 12 to the left hand end of intermediate piston rod guide 56, which at that location has radially extending passages 64 providing communication between annular passage 60 and the intermediate piston portion 38 on the left hand side of sealing ring 52. Similarly, on the right hand side of sealing ring 58, the intermediate piston rod guide 56 has a reduced diameter providing an annular passage 66 extending from a passage 68 in the housing 12 to the right hand side of intermediate piston rod guide 56, which at that location has radially extending passages 70 providing communication between annular passage 66 and the intermediate piston rod portion 38 on the right hand side of sealing ring 52.

The spool valve 30 is operable by the trigger 18 to cause pressurized gas to be supplied to passage 62 or passage 68 to cause piston rod 32 to move from the loading position to the firing position or from the firing position to the loading position. The spool valve 30 has a spool valve member 71 slidably mounted in a passage 72 in the housing 12, and the spool valve member 71 has a longitudinally extending central passage through which a guide rod 74 passes, the guide rod 74 being supported at opposite ends by spacers 76, 78. The guide rod 74 is restrained against longitudinal movement by a retainer 80 in passage 72 between the guide rod 74 and the open end of the passage 72 at the rear end of housing 12, the retainer 80 having an enlarged rear end portion 84 seated in the recess 83 in the rear end of housing 12 and carrying a sealing ring 85 engaging the wall of passage 72 in a sealing manner. The retainer 80 also has an enlarged front end portion adjacent the guide rod 74 and carrying a sealing ring 81 engaging the wall of passage 72 in sealing manner.

The spool valve member 71 has two longitudinally spaced annular recess 86, 88 isolated and separated by three sealing rings 90, 92, 94 and is resiliently urged to the left (in FIGS. 1 & 2) by spring 96 which acts between the valve member 71 and the spacer 78. The passages 62, 68 communicate with the passage 72 at longitudinally spaced positions. A gas supply passage 98 supplies gas under pressure from pressure regulator 28 to passage 72, and two longitudinally spaced passages 100, 102 on opposite sides of gas supply passage 98 extend from passage 72 to the exterior of housing 12, i.e. to atmosphere.

The trigger 18, which is pivotally mounted by a pivot pin 104 in the housing 12, has an actuating arm 106 engaging the spool valve member 71 at the left hand end. When the trigger 18 is not actuated, the spool valve member 71 is held by spring, 96 in the left hand position shown in FIG. 1 in which gas pressure in supply passage 98 is passed through annular passage 88 in spool valve member 71, and through passage 68 to the right hand side of sealing ring 52 on intermediate piston rod portion 38. The left hand side of sealing ring 52 is vented to atmosphere through annular passage 60, passage 62, annular passage 86 and passage 100. The piston rod 32 is therefore held in this position, i.e. the loading position, in which a paintball 22 has fallen down from the supply passage 24 into position in front of piston rod 32.

When the trigger 18 is pulled, i.e. the gun is fired, the spool valve member 71 is moved by the actuating arm 106 against the action of spring, 96 to the position shown in FIG. 2, so that the gas supply passage 98 now passes pressurized gas through annular passage 86, passage 62 and annular passage 60 to the left hand side of sealing ring 52 to move piston rod 32 to the right, as shown in FIG. 2. The right hand side of sealing ring 52 is vented to atmosphere through annular passage 66, passage 68, annular passage 88 and passage 102. The piston rod 32 is thus moved to the firing position shown in FIG. 2, such movement causing the front end portion 36 of piston rod 32 to push the paintball 22 into the barrel 14. When trigger 18 is released, spring 96 returns the spool valve member 71 to the loading position shown in FIG. 1.

The above description explains how pulling the trigger 18 moves the piston rod 32 forwardly to position a paintball 22 in the barrel 14. The manner in which the paintball 22 is fired from the barrel 14 by compressed carbon dioxide gas will now be described.

Gas at a predetermined pressure set by regulator 28 (which will be described in more detail later) passes along a passage 105 in housing 12, along an annular passage 107 around retainer 80, and through a passage 108 in housing 12, a passage 109 in cylinder 34 and a passage 119 in a further intermediate member 120 into a chamber 110 adjacent the rear end of cylinder 34, which is closed by an end member 112. End member 112 has a central passage 114 in which an enlarged rear end 116 of piston rod 32 slides, the rear end of passage 114 being open to the atmosphere through passage 118 in end member 112. Chamber 110 communicates with the portion of passage 114 in front of rear piston rod end 116, which carries a sealing ring 117 engaging the wall of passage 114.

The further intermediate member 120 is located in cylinder 34 adjacent its rear end and forms the right hand side of chamber 110, the intermediate member 120 having an aperture 122 through which the piston rod 32 passes. Forwardly of the piston rod rear end 116, the piston rod 32 has a rear portion 124 which in the firing position (as will be described) is a sliding fit in aperture 122, which contains a sealing ring 125 engageable with piston rod rear portion 124. Forwardly of the rear portion 124, piston rod 32 has a connecting portion 126 of decreased diameter which extends forwardly to a medial portion 128.

Another intermediate member 130 abuts the front end of intermediate member 120 and has a central aperture 132 through which the connecting portion 126 of piston rod 32 passes. The intermediate member 130 is held in position by a tubular member 131 which extends between intermediate member 130 and intermediate member 48. In the loading position (FIG. 1), the rear end 134 of medial portion 128 engages intermediate member 130 which acts as a rear stop preventing further rearward movement of the piston rod 32. The medial piston rod portion 128 is guided in an aperture 136 in an annular support member 138 which extends rearwardly from intermediate member 48, the aperture 136 containing a sealing ring 140.

The forward portions 38, 36 of piston rod 32 have a longitudinal passage 142 which extends from the front end of the medial portion 128 to the front end of the forward portion 36. The rear end of the intermediate portion 38 has passageways 144 extending between the exterior of medial portion 128 and passage 142.

As previously mentioned, front end member 42 of cylinder 34 is seated in upwardly projecting front portion 46 of the housing 12. The rear part of the piston and cylinder assembly 32, 34 is retained in place by a retainer 146 at the rear end of the housing 12. The retainer 146 has an aperture 148 adjacent its upper end shaped to receive and retain the rear end member 112 of cylinder 34. The lower end of retainer 146 is secured by a screw 150 to the hand grip 16.

In the loading position shown in FIG. 1, pressure regulated gas is supplied from pressure regulator 28 (to be described later) through passages 105, 107, 108 109 and 119 to chamber 110. Chamber 110 is thus pressurized, as also is the portion of passage 114 forwardly of piston rod rear end 116, aperture 122, chamber 147 between intermediate members 120, 130, aperture 132, 133 and chamber 148 between intermediate members 130, 48. Further forward travel of pressurized gas is prevented by sealing ring 140 which surrounds medial piston rod portion 128. There is consequently a predetermined volume of gas at a predetermined pressure prevented from forward travel by sealing ring 140. Space between sealing ring 140 and sealing ring 50 is vented to atmosphere through passageways 144 and central passage 142 in piston rod 32.

To fire the gun, the trigger 18 is pulled to cause spool valve member 71 to be moved to the position shown in FIG. 2, thereby causing the piston rod 32 to be moved to the firing position shown in FIG. 2. Thus, as previously described, the front end 36 of piston rod 32 pushes a paintball 22 into the barrel 14. Also, forward movement of the piston 34 causes medial piston rod portion 128 to move forwardly of sealing ring 140. At the same time, rear end portion 124 of piston rod 32 moves into engagement with intermediate member 130 which acts as a forward stop preventing further forward movement of piston rod 32.

Thus, the predetermined volume of gas at the predetermined pressure trapped by the engagement of sealing ring 140 with medial piston rod portion 128 in the loading position is released through aperture 136 the interior of annular support member 138. From the interior of annular support member 138, the gas passes through passageways 144 and central passage 142 in the piston rod 32 to fire the paintball 22 from the barrel 14.

It will be noted that, in the firing position, rear piston rod portion 124 has moved into engagement with sealing ring 125 in intermediate member 120, thereby preventing pressurized gas from passing through aperture 122 in intermediate member 120.

Release of the trigger 18 causes the spring 96 to return the spool valve member 71 to the loading position shown in FIG. 1, with the result that the piston 32 is also returned to the position shown in FIG. 1. A further paintball 22 then drops down from the supply passage 24 into position in front of the piston 32 ready for the next shot.

Each paintball 22 is thus fired in a consistent smooth manner due to the predetermined volume of gas at predetermined pressure used for each shot. Paintball firing velocity can be varied by varying the predetermined pressure by adjustment of the pressure regulator 28 as will now be described.

As shown in FIGS. 4 and 5, the pressure regulator 28 has a main body 160 with a screw threaded inlet recess 162 at one end for receiving the gas cylinder 26. At the opposite end, the body 160 has an outlet passage 164 which communicates with the passage 104 in the housing 12. The upper end of the recess 162 has a downwardly extending projection 166 which engages and opens a valve 228 at the upper end of the gas cylinder 26 when the gas cylinder 26 is screwed into the recess 162, as will be readily apparent to a person skilled in the art. A passage 168 extends upwardly through the body 160 from the upper end of the recess 162 to the lower end of a longitudinally extending bore 170 in the body 160. The bore 170 extends to the upper end of the body 160. A small passageway 169 extends laterally from the interior of the recess 162 through the screw threaded portion of the valve body 160 to the exterior thereof.

A sleeve 172 is slidably mounted in the bore 170 and has three longitudinally-spaced sealing rings 176, 178, 180 which sidingly engage the wall of the bore 170. The sleeve 172 has a laterally extending passageway 182 extending between the interior and exterior of the sleeve 172 between the sealing rings 178, 180. In the non-operating position, the passageway 182 communicates with a laterally extending passage 184 in the regulator body 160 extending between the bore 170 and the exterior of the body 160.

At its lower end, the bore 170 has a short extension 186, from the lower end of which a screw-threaded passageway 188 extends to the exterior of the regulator body 160. An adjuster screw 190 is screwed into passageway 188.

An adjuster spool 192 has an upper end portion slidably mounted in sleeve 172 and a lower end portion slidably mounted in bore extension 186, the upper and lower end portions of the adjuster spool 192 having sealing rings 194, 196 which sealingly engage the inner wall of sleeve 172 and the wall of the bore extension 186 respectively. The adjuster spool 192 has a medial portion 198 of reduced diameter, and has a passageway 200 extending from the exterior of the medial portion 198 to the upper end of the adjuster spool 192.

The bore 170 in regulator body 160 also contains a piston 202 with a piston head 204 which carries a sealing ring 206 in sealing engagement with the wall of the bore 170. The piston 202 also has a shaft 208 extending downwardly from the piston head 204, and the lower end portion of the shaft 200 slides in the upper portion of sleeve 172. The lower end of shaft 202 carries a sealing ring 210 which sealingly engages the interior of the sleeve 172. At its lower end, the shaft 208 has an extension 212 of reduced diameter engageable with the upper end of adjuster spool 192. The lower end of shaft extension 212 has a recess containing a seal 214 which closes the upper end of passage 200 when the shaft extension 212 is in engagement with the upper end of adjuster spool 192. The piston 202 has a passage 216 extending from the exterior of shaft extension 212 through shaft 208 and piston head 204 to the upper end thereof.

A pusher ring 218 loosely surrounds piston shaft 208 and has a lower end engageable with the upper end of sleeve 172. The upper end of pusher ring 218 has a circumferential flange 220 engageable with a stop ring 222 in the form of a circlip mounted in the wall of the bore 170. The stop ring 222 limits downward movement of the pusher ring 218, and also limits upper movement of the sleeve 172. A coilspring 224 surrounds piston shaft 208 and extends between the top of pusher ring 218 and the underside of piston head 204. Upward movement of piston 202 is limited by engagement with a portion (not shown) of the housing 12 when the regulator 28 is secured therein. The space between piston head 204 and sleeve 172 is vented to atmosphere through a passageway 226 in the wall of regulator body 160.

The non-operating condition of the pressure regulator 28 will now be described with reference to FIG. 4. As shown, adjuster screw 190 is screwed fully into passageway 188 so as to maintain adjuster spool 192 in an uppermost position in engagement with piston shaft extension 212, so that piston 202 is held in its uppermost position against stop housing 12. The $CO_2$ cylinder 26 (typically pressurized to 800–1000 psi) is secured to the pressure regulator 28 by screwing the upper end portion of the cylinder 26 into recess 162 in the regulator body 160. The projection 166 in the recess 162 engages and opens the outlet valve 228 on the top of the cylinder 26. A sealing ring 229 carried by the cylinder 26 engages the wall of recess 162 above passage 169 before outlet valve 228 is opened.

Pressurized gas passes from cylinder 26 up the passageway 168 in the regulator body 160. The pressurized gas thus moves sleeve 172 upwardly until the upward movement is limited by engagement of the upper end of sleeve 172 with stop ring 222. The pressurized gas also now passes into the space surrounding the medial portion 198 of adjuster spool 192 and into the passage 200 therein. However, the upper end of passage 200 is closed by seal 214 on the lower end of piston shaft extension 212.

Adjuster screw 190 is then turned one turn counter clockwise to move adjuster screw 190 slightly from the bore extension 168, thereby allowing adjuster spool 192 to lower slightly and create a gap between the upper end of passage 200 and seal 214. Pressurized gas therefore now passes into the upper portion of sleeve 172 and through passage 216 in piston 202 to the space above piston head 204. Pressurized gas then acts on the upper surface of piston head 204 to force the piston 202 downwardly against the action of spring 224 to close the passage 200 in adjuster spool 172.

Further unscrewing movement of the adjuster screw 190 lowers the adjuster spool 192 still lower, with the result that a higher pressure is required above piston head 204 to force piston 202 downwardly against the action of spring 224 to close the passage 200. As previously mentioned, the space in which spring 224 is located is vented to atmosphere through passageway 226 so as to prevent any air compression or air lock in that space which might interfere with desired movement of piston 202.

Thus, in operation, the gas pressure supplied by regulator 28 to passageway 104 in housing 12 is set by the setting of adjuster screw 190. FIG. 5 shows the position of various parts of the regulator 28 when in operating and the pressure in passage 104 is at the desired value.

When the gas cylinder 26 has to be changed, the cylinder 26 is unscrewed from the recess 162 in regulator body 160. Valve 228 in the top of the cylinder 26 closes as soon as it is free from projection 165, and recess 162 vents through passageway 169. Pressure in passageway 168 is therefore also vented, with the result that sleeve 172 is returned to the bottom of the bore 170 through the action of the spring 224 acting through pusher ring 218. In its lowest position, passageway 182 in sleeve 172 communicates with passageway 184 in the wall of the regulator body 160, thereby venting the upper portion of sleeve 172 to atmosphere, which in turn vents passageway 104 in housing 12 through piston passage 216.

Other embodiments of the invention will be readily apparent to a person skilled in the art, the scope of the invention being defined in the appended claims.

We claim:

1. A gas powered gun comprising:

a gun barrel, a cylinder containing a piston rod slidably movable between a loading position in which the leading end of the piston rod is sufficiently withdrawn in the barrel to permit a projectile to be fed into the barrel through an opening in the side thereof, and a firing position in which the piston rod has moved forwardly to cause the leading end of the piston rod to engage the projectile and move the projectile forwardly in the barrel, a trigger operable to cause the piston rod to move from the loading position to the firing position, a pressurized gas supply, said cylinder having first and second chambers through which the piston rod extends, said pressurized gas supply supplying pressurized gas to the first chamber when the piston rod is in the loading position, said piston rod permitting communication between the pressurized gas supply and the first chamber and preventing communication between the first and second chambers when in the loading position, and when in the firing position preventing communication between the pressurized gas supply and the first chamber and permitting communication between the first chamber and the second chamber to cause pressurized gas in the first chamber to pass into the second chamber, said piston rod having a longitudinally extending passage extending from the front and rearwardly along the piston rod to a location where the passage communicates with the exterior of the piston rod, and said location communicating with the second chamber when the piston rod is in the firing position to cause pressurized gas to pass from the second chamber into the longitudinally extending passage to the front end of the piston rod to propel the projectile from the gun barrel.

2. A gun according to claim 1 wherein the cylinder has a first member separating the first chamber from the second chamber, said first member having a first aperture through which the piston rod passes, and the piston rod having a first portion which is located in and closes the aperture when the piston rod is in the loading position and a second portion of lesser cross-section than the first portion which extends through the aperture when the piston rod is in the firing position to permit pressurized gas to pass from the first chamber through the first aperture into the second chamber.

3. A gun according to claim I wherein the cylinder has a second member separating a gas supply chamber from the first chamber, said second member having a second aperture through which the piston rod passes, and the piston rod having a third portion of smaller cross-section than the second aperture which is located in the second aperture when the piston rod is in the loading position to permit pressurized gas to pass from the gas supply chamber to the first chamber and a fourth portion of larger diameter than the third portion and which is located in and closes the second aperture when the piston rod is in the firing position to prevent pressurized gas from passing from the gas supply chamber into the first chamber.

4. A gun according to claim 3 wherein said fourth portion of the piston rod is adjacent a rear end thereof, and the cylinder has a rear portion which supports and guides the rear end of the piston rod.

5. A gun according to claim 1 wherein the piston rod is moved in at least one direction between said loading and firing positions by the pressurized gas supply, said gun having a valve receiving pressurized gas from the pressurized gas supply, said cylinder having an actuating portion through which the piston rod passes, and said valve being operatively connected to the trigger whereby movement of the trigger causes the valve to supply pressurized gas to the actuating portion of the cylinder to move the piston rod from one position to another.

6. A gun according to claim 5 wherein hand movement of the trigger causes the valve to supply pressurized gas to the actuating portion of the cylinder to cause the piston rod to move from the loading position to the firing position, and release of the trigger after firing movement causes the valve to supply pressurized gas to the actuating portion of the cylinder to cause the piston rod to return from the firing position to the loading position.

7. A gun according to claim 1 also including an adjustable pressure regulator connected between the pressurized gas supply and the first chamber, said regulator comprising a regulator body having a piston slidable in a bore therein, said piston having a piston rod extending rearwardly therefrom, a spring surrounding piston rod and urging the piston to a forward position, the piston and piston rod having a passage extending therethrough, the housing also containing a sleeve in which a rear end portion of the piston rod slides, an adjustable spool slidably mounted in the sleeve below the piston rod, the pressurized gas supply being supplied to a rear end of the sleeve and the piston being acted upon by the regulator output pressure in a direction opposing said spring, the sleeve and the regulator body having passages which communicate with each other only when the pressurized gas supply is disconnected to vent pressure in the piston and piston rod passages to atmosphere.

8. A piston and cylinder assembly for a gas powered gun, said piston assembly comprising:

a cylinder containing a piston rod slidably movable between a loading position in which the leading end of the piston rod is in a withdrawn position, and a firing position in which the piston rod has moved forwardly, said cylinder having first and second chambers through which the piston rod extends, said cylinder being connectable to a pressurized gas supply supplying pressurized gas to the first chamber when the piston rod is in the loading position, said piston rod permitting communication between the pressurized gas supply and the first chamber and preventing communication between the first and second chambers when in the loading position, and when in the firing position preventing communication between the pressurized gas supply and the first chamber and permitting communication between the first chamber and the second chamber to cause pressurized gas in the first chamber to pass into the second chamber, said piston rod having a longitudinally extending passage extending from the front and rearwardly along the piston rod to a location where the passage communicates with the exterior of the piston rod, and said location communication with the second chamber when the piston rod is in the firing position to cause pressurized gas to pass from the second chamber into the longitudinally extending passage to the front end of the piston rod for propelling a projectile from the barrel of a gas powered gun.

9. A piston and cylinder assembly according to claim 8 wherein the cylinder has a first member separating the first chamber from the second chamber, said first member having a first aperture through which the piston rod passes, and the piston rod having a first portion which is located in and closes the aperture when the piston rod is in the loading position and a second portion of lesser cross-section than the first portion which extends through the aperture when the piston rod is in the firing position to permit pressurized gas to pass from the first chamber through the first aperture into the second chamber.

10. A piston and cylinder assembly according to claim 8 wherein the cylinder has a second member separating a gas supply chamber from the first chamber, said second member having a second aperture through which the piston rod passes, and the piston rod having a third portion of smaller cross-section than the second aperture which is located in the second aperture when the piston rod is in the loading position to permit pressurized gas to pass from the gas supply chamber to the first chamber and a fourth portion of larger diameter than the third portion and which is located in and closes the second aperture when the piston rod is in the firing position to prevent pressurized gas from passing the gas supply chamber into the first chamber.

11. A piston and cylinder assembly according to claim 10 wherein said fourth portion of the piston rod is adjacent a rear end thereof, and the cylinder has a rear portion which supports and guides the rear end of the piston rod.

12. A piston and cylinder assembly according to claim 8 wherein the piston rod is moveable in at least one direction between said loading and firing positions by a pressurized gas supply, said cylinder having an actuating portion through which the piston rod passes, and to which pressurized gas can be supplied to move the piston rod from one position to another.

13. A piston and cylinder assembly according to claim 12 wherein pressurized gas can be supplied to the actuating portion of the cylinder to cause the piston rod to move from the loading position to the firing position, and pressurized gas can also be supplied to the actuating portion of the cylinder to cause the piston rod to return from the firing position to the loading position.

* * * * *